US007973002B2

(12) United States Patent
Fregonese et al.

(10) Patent No.: US 7,973,002 B2
(45) Date of Patent: Jul. 5, 2011

(54) DETERGENT COMPOSITION

(75) Inventors: Daniele Fregonese, Novara (IT); Chris Efstathios Housmekerides, Ludwigshafen (DE); Pavlinka Roy, Ludwigshafen (DE); Ralf Wiedemann, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 663 days.

(21) Appl. No.: 11/913,010

(22) PCT Filed: May 9, 2006

(86) PCT No.: PCT/GB2006/001657

§ 371 (c)(1),
(2), (4) Date: Nov. 13, 2007

(87) PCT Pub. No.: WO2006/120405

PCT Pub. Date: Nov. 16, 2006

(65) Prior Publication Data

US 2008/0161218 A1 Jul. 3, 2008

(30) Foreign Application Priority Data

May 9, 2005 (GB) ..... 0509377.8
Jun. 24, 2005 (GB) ..... 0512870.7

(51) Int. Cl.
*C11D 7/18* (2006.01)
*C11D 7/38* (2006.01)
*C11D 7/54* (2006.01)
*C11D 17/00* (2006.01)

(52) U.S. Cl. ..... 510/224; 510/221; 510/296; 510/302; 510/303; 510/304; 510/310; 510/371; 510/372; 510/376; 510/439; 510/470; 510/475; 510/477; 510/489; 510/501; 252/186.26; 134/25.2; 8/111; 8/137

(58) Field of Classification Search ..... 510/220, 510/221, 296, 302, 303, 304, 310, 371, 372, 510/376, 439, 470, 475, 477, 489, 501, 224; 252/186.26
See application file for complete search history.

(56) References Cited

U.S. PATENT DOCUMENTS

| | | | |
|---|---|---|---|
| 6,509,308 | B1 | 1/2003 | De Buzzaccarini |
| 2004/0147423 | A1 | 7/2004 | Scialla et al. |

FOREIGN PATENT DOCUMENTS

| | | | |
|---|---|---|---|
| EP | 0852259 | A | 7/1998 |
| EP | 0890635 | A | 1/1999 |
| EP | 1518922 | A1 | 3/2005 |
| GB | 2401371 | A | 11/2004 |
| GB | 2406338 | A | 3/2005 |
| WO | 00/27966 | A | 5/2000 |
| WO | 2004/055149 | A | 7/2004 |
| WO | 2004/081161 | A | 9/2004 |
| WO | 2005/100525 | A | 10/2005 |

*Primary Examiner* — Gregory R Del Cotto
(74) *Attorney, Agent, or Firm* — Andrew N. Parfomak; Norris McLaughlin & Marcus, PA

(57) ABSTRACT

A composition comprising phthalimidoperhexanoic acid (PAP) is provided. The PAP has a particle size of 0.01 to 100 μm and a particle size distribution with x(50) of less than 10 μm. Preferably the composition is a detergent composition.

17 Claims, No Drawings

DETERGENT COMPOSITION

This is an application filed under 35 USC 371 of PCT/GB2006/001657.

The present invention relates to a composition. The composition is for incorporation into a detergent product.

Bleaches in detergent compositions are well known. Their presence is necessary to treat stains, especially to remove coloured stains from items being washed.

Typically bleaches comprise peroxide based compounds that produce/release active singlet oxygen in washing liquor. This has been extensively demonstrated as being the chemical species responsible for the bleaching process. Examples of such bleaches include per-salts such as perborate and percarbonate and also organic carbonates are used.

The bleaches are commonly employed in conjunction with a bleach activator (such as TAED) which increase the activity of the bleach at lower washing temperatures (<40° C.).

There is continual pressure upon detergent manufacturers and retailers to produce new products and especially products which are more cost efficient to manufacture (and sell) than those currently available.

Ways in which to achieve this result include the use of less expensive ingredients, or, to use the current ingredients at a lower but still effective concentration.

PAP (phthalimidoperhexanoic acid) has been used as a bleach in detergent formulations, e.g. as described in EP-A-0 390 387 and EP-A-0 653 485.

PAP is usually manufactured and crystallised from solution in needle shape with the needles having a particle size of greater than 10 μm. Such particles show good stability but result in poor availability of PAP in solution e.g. in a washing process.

PAP may be stabilised with boron compounds such as described in U.S. Pat. No. 4,100,095. However, for environmental reasons the use of boron is less favoured and preferably avoided. Other stabilisers are discussed in U.S. Pat. No. 4,686,063 which describes fatty peroxyacid and low levels of an exotherm control agent (urea). U.S. Pat. No. 3,770,816 describes diperisophthalic compositions using alkali metal sulfates as exotherm control agents. EP-A-0 816 481 describes peracid granules containing citric acid monohydrate for improved dissolution rates, wherein the citric acid is an exotherm control agent. EP-A-0 852 259 describes granular compositions of PAP and phthalic acid and N-oxides as exotherm control agents. WO 2004/081161, GB 2 401 371 and GB 2 406 338 disclose a package comprising a detergent composition comprising PAP in granular form and having a particle size of from 10-50 μm enclosed by water-soluble or water-dispersible packaging material. U.S. Pat. No. 6,509,308 B1 discloses bleaching compositions comprising a preformed peroxygen bleach having a particle size of less than 100 microns. US 2004/0147423 discloses aqueous laundry products provided in a first and second part wherein the second part comprises a peroxyacid bleaching composition which may comprise PAP. EP-A-1 518 922 discloses machine dishwashing formulations which may comprise encapsulated PAP particles as a bleaching component.

It is an object of the present invention to address one or more of the problems associated with the prior art outlined above.

According to a first aspect of the present invention there is provided a composition comprising phthalimidoperhexanoic acid (PAP), wherein the PAP has a particle size of 0.01 to 100 μm and a particle size distribution with x(50) of less than 10 μm.

x(50) shall be taken to mean that 50% of the volume of particles have a particle size smaller than, or equal to, x as defined in DIN 66141.

Preferably the PAP composition is solid. Preferably the composition is a detergent composition.

It has been observed that PAP compositions having substantially a particle size of 0.01 to 100 μm and a particle size distribution of x(50) less than 10 μm avoid production/manufacturing issues caused by larger particle size materials (e.g. such as when incorporating such compositions into gels or pastes). Also PAP compositions having the defined particle size have the advantage of being easily compactable so that they can be handled in filling processes (such as the filling of (hard gelatine) capsules) without dust formation in small portions.

We have now found that detergent compositions containing PAP compositions having a x(50) particle size of less than 10 μm are able to provide excellent bleach activity. Without wishing to be bound by theory it is proposed that the reason for this high activity is a result of the ability of PAP to disperse/dissolve quickly.

PAP compositions according to the invention can be manufactured in milling processes at low yields using e.g. pin mills or impact crusher mills. Those mills normally give a substantial thermal stress to the milled product which can lead to a decomposition of part of the peracid.

Most preferably the PAP particles are manufactured in a Jet Mill (e.g. as described in EP-A-1 172 149). By means of this technology it has been possible to obtain an extraordinary narrow particle distribution size and very low X(50), e.g. 6.4 μm. Furthermore this process can be operated without loss of PAP activity.

The PAP composition may contain a second component. Namely the PAP particles may be incorporated into a larger granule or alternatively the PAP particles and another granular component may together comprise an admixture. It is preferred according to the present invention that the PAP particles are admixed with a peracid stabilisation agent.

According to an especially preferred aspect of the pre-sent invention the PAP particles are incorporated into a larger granule. This is preferably achieved by further granulation of the PAP particles or PAP composition; the PAP particles or PAP composition may be granulated by themselves in order to product larger agglomerated particles, or, they may be granulated with additional materials. In both cases the so-granulated material comprises PAP particles having a particle size of 0.01 to 100 μm and a particle size distribution with x(50) of less than 10 μm even though the granulated material may have a substantially larger particle size. Accordingly it is preferred according to the present invention that the PAP particles are granulated either alone or with one or more ingredients of the PAP composition.

Granulation of the PAP particles or composition may occur by any known suitable manner including wet granulation methods such as those using a polyacrylate and/or a derivative thereof. This further granulation step provides an additional advantage of easier processing and handling of the PAP whilst substantially retaining its efficacy.

Indeed the PAP may be processed in the presence of a peracid stabilisation agent. The process may be designed such that a pre-formed granule comprising the PAP and a peracid stabilisation agent is added to the mill for milling. Alternatively the PAP and a peracid stabilisation agent may be added separately to the mill, even to different parts of the mill.

The milling in the presence of a stabilising agent has the advantage of reducing the contact of PAP with the milling tools. Furthermore the heat capacity relative to PAP is increased. Also the build up of impurities on tools resulting from depositing PAP in the mill is substantially reduced. Additionally as the stabilising agent is of similar particle size to the PAP this leads to reduced segregation when handling the PAP particles.

Preferred examples of stabilising agents include compounds such as described in U.S. Pat. No. 4,100,095, U.S. Pat. No. 4,686,063, U.S. Pat. No. 3,770,816, EP-A-0 816 481, EP-A-0 852 259 and carbohydrates, polyols such as sorbitol, oligocarboxylates, polyacrylates, polyvinylacetates, polyvinylalcohols, polycarbohydrates, phosphate derivatives (such as STPP) and derivatives thereof. In particular sulphonated polyacrylate polymers and carbohydrates show good performance.

The stabilising agent may be incorporated at up to 80% wt, preferably up to 60% wt and most preferably up to 40% wt of the weight of PAP containing particles.

In order to prevent caking and agglomeration of the particles sometimes other components are added such as: NaCl, $Na_2SO_4$, $Na_2CO_3$, silica, saccharose, $K_2SO_4$, $K_2CO_3$, and KCl.

Preferably the composition is contained within a water soluble/dispersible pouch. The pouch is preferably formed of a film, shell, an extruded cage or an injection moulded cage.

The pouch may be produced by any suitable process, for example by injection moulding or with the use of a film. Where a film is used the film may be a single film, or a laminated film such as disclosed in GB-A-2,244,258.

The thickness of the film may be up to 2 mm, more preferably up to 1 mm, more preferably 40 to 300 μm, more preferably 60 to 200 μm, especially 60 to 160 μm, more especially 60 to 150 μm.

The film may be produced by any process, for example by extrusion and blowing or by casting. The film may be unoriented, monoaxially oriented or biaxially oriented. If the layers in the film are oriented, they usually have the same orientation, although their planes of orientation may be different if desired.

The layers in a laminate may be the same or different. Thus they may each comprise the same polymer or a different polymer.

Examples of water-soluble polymers which may be used in a single layer film or in one or more layers of a laminate or which may be used for injection moulding or blow moulding are poly(vinyl alcohol) (PVOH), cellulose derivatives such as hydroxypropyl methyl cellulose (HPMC) and gelatin. An example of a preferred PVOH is ethoxylated PVOH. The PVOH may be partially or fully alcoholised or hydrolysed. For example it may be from 40 to 100%, preferably from 70 to 92%, more preferably about 88% or about 92%, alcoholised or hydrolysed. The degree of hydrolysis is known to influence the temperature at which the PVOH starts to dissolve in water. 88% hydrolysis corresponds to a film soluble in cold (ie room temperature) water, whereas 92% hydrolysis corresponds to a film soluble in warm water.

The pouch may be formed by, for example, vacuum forming or thermoforming. For example, in a thermoforming process the film may be drawn down or blown down into a mould. Thus, for example, the film is heated to the thermoforming temperature using a thermoforming heater plate assembly, and then drawn down under vacuum or blown down under pressure into the mould. Plug-assisted thermoforming and pre-stretching the film, for example by blowing the film away from the mould before thermoforming, may, if desired, be used. One skilled in the art can choose an appropriate temperature, pressure or vacuum and dwell time to achieve an appropriate pouch. The amount of vacuum or pressure and the thermoforming temperature used depend on the thickness and porosity of the film and on the polymer or mixture of polymers being used. Thermoforming of PVOH films is known and described in, for example, WO 00/55045.

A suitable forming temperature for PVOH or ethoxylated PVOH is, for example, from 90 to 130° C., especially 90 to 120° C. A suitable forming pressure is, for example, 69 to 138 kPa (10 to 20 p.s.i.), especially 83 to 117 kPa (12 to 17 p.s.i.). A suitable forming vacuum is 0 to 4 kPa (0 to 40 mbar), especially 0 to 2 kPa (0 to 20 mbar). A suitable dwell time is, for example, 0.4 to 2.5 seconds, especially 2 to 2.5 seconds.

While conditions are desirably chosen within the above ranges, it is possible to use one or more of these parameters outside the above ranges, although it may be necessary to compensate by changing the values of the other two parameters.

The pouch may be in the form of a solid body. That is to say the pouch is not in the form of a walled container but instead a shape, which is substantially solid (optionally with pores/apertures). The solid preferably comprises a matrix. The matrix may be formed of the material used for the film of the pouch or alternatively the matrix may comprise a second material. Preferred matrix forming materials include gelatin, especially in an admixture with glycerine, optionally with water. A further preferred matrix forming material is polyethylene glycol (PEG) having a molecular mass of 3000 or above, e.g. such as 6000, 8000, 20000, 35000 or 8 million.

Generally the pouch has dimensions of between 5 and 50 mm at the widest point. It will be appreciated that the size may vary in accordance with the intended use of the pouch: when the pouch is intended for use as a booster it may be relatively small (e.g. around 7-11 mm in diameter) when the pouch is intended for use a "complete" detergent it may be relatively large (e.g. around 35-45 mm in diameter).

The pouch generally comprises up to 100 g, especially up to 40 g, 30 g, 20 g, 15 g, 10 g, 5 g or 1 g of the composition. For example, a dishwashing composition may be included in an amount of from 15 to 30 g, a water-softening composition may be included in an amount of from 15 to 40 g.

The pouch is typically based on a cuboid or a sphere.

The pouch may be completely filled or only partially filled with the composition. The composition contained therein may be particulate in the form of a powder/tablet a tablet. It may also be transformed into a liquid, which may be thickened or gelled if desired. The liquid composition may be non-aqueous or aqueous, for example comprising less than or more than 5% total or free water. The composition may have more than one phase. For example it may comprise an aqueous composition and a liquid composition which is immiscible with the aqueous composition. It may also comprise a liquid composition and a separate solid composition, for example in the form of a ball, pill or speckles.

The composition may comprise a carrier fluid. This could serve as a processing aid or a stability aid. Preferred examples of carrier fluids include hydrophobic oils such as paraffin oil, vegetable oils (e.g. olive oil/sunflower oil), a silicone oil, polyethylene glycol (PEG) (preferably having a molecular weight of from 200 to 4000) or an admixture thereof.

It has been found that where the pouch contains PEG as a carrier fluid the pouch finds excellent utility when sold as a bleach booster. Most preferably the PEG comprises an admixture of low and high molecular weight PEG. Preferably the ratio of low to high molecular weight PEG is approximately equal. This admixture has been found to provide a fast dissolution time for the PAP in the wash. Also this mixture is able to dissolve the PAP.

In a preferred form of this embodiment the compartment comprises a shell of a water-soluble material. Suitable water-soluble materials include water-soluble polymers such as polyvinyl alcohol, cellulose derivatives such as hydroxypropylmethyl cellulose (HPMC) and gelatine. Gelatin is an especially preferred material for the shell.

Thus preferably the compartment comprises:

(a) A water-soluble shell comprising substantially water-soluble materials such as those mentioned in the immediately preceding paragraph (b) 36% wt low molecular weight PEG such as (PEG 300)

(c) 24% wt high molecular weight PEG such as (PEG 3000)

(d) 40% wt PAP

Preferably the compartment has a weight of from 1-10 g most preferably from 1-5 g e.g., such as 2-3 g.

It has been surprisingly found that when paraffin oil is used as carrier fluid its density and viscosity plays a big role in the processability of the mixture carrier and PAP. In particular with an oil having a kinematic viscosity at 40° C. of from 5.7 to 1.7 $mm^2$/sec. it is possible to obtain a mixture having an high concentration of PAP (higher than 44% wt) and with rheological behaviour suitable for encapsulation in water-soluble (e.g. gelatine) capsules. Moreover with an oil having a kinematic viscosity at 40° C. of 16 $mm^2$/sec, it is possible to obtain a mixture with a lower concentration of PAP (lower than 38% wt).

Suitable paraffin oils include Weissoil W 1100 from Fuchs GmbH and COX™ 40 TW40C sold by Merkur SA.

The following formulation may be prepared by mixing together a PAP composition having an x(50) less than 10 μm and a suitable paraffin oil;

(a) 55% wt Paraffin oil (e.g. Weissoil W100 ex Fuchs GmbH), and (b) 45% wt PAP with an x(50) of less than 10 μm.

In addition it has been observed that by using PAP with such fine granulometry its inclusion in compartments, capsules and sachets etc is greatly accelerated with a consequent improvement of its industrial manufacturing.

Alternatively PAP can be encapsulated in a capsule made of a water-soluble material, such as water-soluble polymer. Suitable examples include polyvinyl alcohol, cellulose derivatives such as hydroxypropyl methyl cellulose and gelatin. The same water-soluble polymers as described hereinabove with reference to films may be used for the capsules. For example the so-called soft gelatine may be used by using special encapsulation equipment such as those described in EP-A-1,258,242 that allow encapsulation, at higher cost, of solid PAP without the means of carrier liquids.

The pouch may (as mentioned above) be sold and used separately as a bleach booster.

Alternatively the pouch or capsule may be incorporated within/attached to a detergent tablet formulation.

In a further embodiment the pouch may comprise a multi-compartment structure (soluble/dispersible in water), wherein one compartment contains the PAP composition and a separate compartment contains a different composition (e.g. a conventional detergent composition). Such a multi-compartment structure may take any recognised form of superposed, side-by-side compartments or compartments within compartments, e.g. as described in EP-A-1337619 incorporated herein by reference. In a particularly preferred embodiment the PAP composition is present within an internal compartment which is completely surrounded by a second composition (e.g. a conventional detergent composition) contained within a second larger compartment. In such multi-compartment structures the composition(s) present in the other compartment(s) may individually be in liquid or powder form.

By using a multi-compartment/multi-media structure it is possible to ensure that the components are released at different times. Thus, for instance, one composition can be released immediately as the body is added to water, whereas the other may be released later as the pouch becomes dissolved/dispersed.

Where the multi-component product comprises a body made by thermoforming, it has been found particularly advantageous if the following order of assembly is adhered to: — i) the body compartment is formed;

ii) the pouch is added to the body compartment;

iii) the body composition is added to the body compartment; and iv) the body compartment is sealed.

It has been found that if the procedure above is followed then there is little or no splashing of the body composition caused by the addition of the pouch. This has the advantage that any sealing problems caused by splashing of the body composition onto the exterior of the body compartment/parts are obviated.

Where the multi-component product comprises a pouch and a tablet then preferably the pouch is attached to the tablet. More preferably the pouch is at least partially inserted into a suitable aperture in a surface of the tablet. Indeed it is most preferable that the pouch is received in an aperture such that about half of the pouch protrudes above the surface of the tablet. A plurality of pouches may be attached to a tablet.

Generally the pouch is attached to the tablet by a glue. Preferred examples of glue suitable in this application include gelatin, sorbitol and PEG having a molecular weight greater than 1000.

The tablet may be extruded, injection moulded or may be in a form produced from compressed particulate components.

The tablet generally comprises one or more general detergent components. These include conventional detergent composition components, such as surfactants, builders, alkalies, filler, binders, bleaches, bleach enhancing agents, silver-corrosion inhibiting agents, enzymes, enzyme stabilisers, soil release agents, dye transfer inhibiting agents, brighteners, perfumes, colourants and dyes.

The tablet may comprise one or more separate zones. The zones may be arranged in layers.

The PAP composition may be incorporated in a detergent composition. Thus in accordance with a second aspect of the invention there is a provided a detergent composition comprising phthalimidoperhexanoic acid (PAP), wherein the PAP has a particle size of 0.01 to 100 μm and a particle size distribution with x(50) less than 10 μm.

The detergent composition of the invention is preferably used in a domestic environment for washing and/or treatment of clothes or washing of hard surfaces including glassware and/or kitchen ware. The composition may typically be used in domestic laundry and dishwashing operations, including in automatic laundry machines and automatic dishwashers. The composition may take the form of a complete detergent or in the alternative may take the form of a separate additive. In the latter case the additive may used for removing stains on crockery/kitchenware in a separate liquor before the items are washed in a dishwasher. The additive can also be used in a liquor together with either a bleach-free washing agent or a bleach-containing washing agent as a bleach booster.

The excellent solubility of the PAP in the detergent composition is particularly important as most automatic washing machines begin their operation cycle at a relatively low temperature before heating up to a higher temperature. This is especially true for automatic dishwashing machines. PAP granules having the particle size as stated herein are able to effectively disperse/dissolve before the temperature of the wash liquor is such that the activity of the PAP is compromised.

Furthermore the quick dissolution speed means that the PAP component may be completely dissolved/dispersed before the remainder of the detergent composition. This is especially relevant where the remainder of the detergent composition is a solid/viscous liquid. As detergent compositions (especially dishwasher detergent compositions) are highly alkaline the effect of the dissolution is to alter the pH of the liquor so that it to is highly alkaline. Thus PAP having the particle size as stated herein is able to dissolve before the majority of the detergent and before the alkalinity of a wash liquor is such that the activity of the PAP is compromised.

The detergent composition preferably has no degrading effect on PAP. To achieve this (e.g. in relatively aggressive compositions) the PAP particles may be coated with a protective sheath (e.g. such as a coating) or may be incorporated into a separate compartment of the detergent e.g. in a capsule/pouch.

The detergent composition may comprise a builder. In this regard it has been found that the addition of a builder to the composition greatly enhances the activity of the PAP on bleachable stains (such as tea). It is postulated that this enhanced activity arises as the builder is able to chelate metal ions (such as calcium, iron, zinc or copper) which may be present in the dishwasher liquor. These metal ions could otherwise interfere with the performance of the PAP as the metals may allow their oxidation state to be effected by the PAP (and in doing so the PAP is de-activated).

Preferred builders include phosphorous based builders, such as tripolyphosphate e.g., potassium tripolyphosphate, the oligocarboxylate or polycarboxylate type, such as compounds selected from the group consisting of sodium citrate, sodium polyacrylate and its copolymers, sodium gluconate, nitroloacetic acid (NTA), ethylendamminotetracetate (EDTA), succinic acid, polyaspartic acid, polyglycine, phosphonic acid or an admixture thereof. Most preferably the builders are NTA and phosphonic acid pre-sent in a 1:1 weight ratio.

Alternatively the builder is an alkali metal (e.g. sodium/potassium) citrate salt.

The detergent composition may contain a sulphonated polymer. This has been found to be especially beneficial in the removal of spots/flecks from hard surfaces.

The sulphonated polymer preferably comprises a copolymer. Preferably, the copolymer comprises the following monomers:

(I) 50-90% by weight of one or monoethylenically unsaturated $C_3$-$C_6$ monocarboxylic acid;

(II) 10-50% by weight of unsaturated sulphonic acid;

Advantageously, the copolymer comprises:

(I) 60-90% by weight of one or monoethylenically unsaturated $C_3$-$C_6$ monocarboxylic acid.

(II) 10-40% by weight of unsaturated sulphonic acid;

More advantageously the copolymer comprises.

(I) 77% by weight of one or monoethycally unsaturated $C_3$-$C_6$ monocarboxylic acid (II) 23% by weight of unsaturated sulphonic acid.

The monoethylenically unsaturated $C_3$-$C_6$ monocarboxylic acid is preferably (meth)acrylic acid.

The unsaturated sulphonic acid monomer is preferably one of the following: 2-acrylamido methyl-1-propanesultonic acid, 2-methacrylamido-2-methyl-1-propanesulphonic acid, 3-methacrylamido-2-hydroxypropanesulphonic acid, allysulphonic acid, methallysulphonic acid, allyloxybenzenesulphonic acid, methallyloxybenzensulphonic acid, 2-hydroxy-3-(2-propenyloxy)propanesulphonic acid, 2-methyl-2-propene-1-sulphonic acid, styrene sulphonic acid, vinylsulphonic acid, 3-sulphopropyl acrylate, 3-sulphopropyl methacrylate, sulphomethylacrylamid, sulphomethylmethacrylamide, and water soluble salts thereof.

The unsaturated sulphonic acid monomer is most preferably 2-acrylamido-2-propanesulphonic acid (AMPS).

The weight average molecular weight of the copolymer according to the present invention is from 3,000 to 50,000 and preferably from 4,500 to 35,000.

Commercially available examples of the preferred sulphonated polymer are available from Rohm & Haas under the trade names Acusol™ 587G and Acusol™ 588G Where the sulphonated polymer is present it may comprise up to 10 wt % of the detergent composition (e.g. such as up to 5 wt % or between 1-2 wt %).

The detergent composition optionally comprises one or more additional ingredients. These include conventional detergent composition components, such as surfactants, bleaches, bleach enhancing agents, silver-corrosion inhibiting agents, enzymes, enzyme stabilisers, soil release agents, dye transfer inhibiting agents, brighteners, perfumes, colourants and dyes.

According to a second aspect of the invention there is provided the use of a composition in accordance with the first aspect of the invention for the washing and/or treatment of clothes (preferably in an automatic washing process e.g. laundry) and/or the washing of hard surfaces including glassware and/or kitchenware (such as dishwashing).

Further details and advantages of the invention can be seen from the following examples. Further examples within the scope of the present invention will be apparent to the person skilled in the art.

EXAMPLES

Example 1

PAP

A PAP granule (X(50) higher than 200 μm) (the PAP having an X(50) larger than 10 μm), comprising 70% PAP and 30% of a component from Table b was milled using a Jet Mill to obtain a milled composition having an extraordinarily narrow particle distribution size and a low X(50) of 6.4 μm as shown in Table A below.

TABLE A

| Particle size in μm | Fraction (%) |
|---|---|
| <5 | 40% |
| <10 | 60% |
| <15 | 75% |
| <20 | 83% |
| <50 | 91% |
| <80 | 96% |
| <100 | 100% |

The PAP as produced above was blended with a raw material of the following list, in a weight ratio of 1 to 1, and stored at 30° C./70% R.H.

The activity of PAP in those blends is assessed after 6 and 12 weeks of storage and is shown in Table B below.

TABLE B

| Raw material blend | PAP activity after 6 weeks | PAP activity after 12 weeks |
|---|---|---|
| STPP | 90.7% | 84.7% |
| PVOH | 98.7% | 97.4% |
| Sorbitol | 96.7% | 86.7% |
| Saccharose | 94.3% | 80.3% |
| Maltodextrin | 98.3% | 95.4% |
| Modified starch | 100% | 99.9% |
| Mannitol | 99% | 94.1% |
| Xylitol | 95.7% | 86.1% |
| Sulfonated polyacrylate | 88.4% | 78.2% |

These materials show good stability of the PAP.

In contrast sodium carbonate or sodium bicarbonate lead to loss of PAP activity of greater than 90% after 12 weeks in the same test conditions.

Example 2

Pouches Enclosed by a Water Dispersible Material

The following formulation was prepared by mixing together the indicated components in the weight proportions indicated to prepare a heavy duty dishwasher liquid. All percentages are by weight.

| | |
|---|---|
| Amylase (Genencor) | 0.3% |
| Properase (Genencor) | 0.6% |
| Sorbitol (70% aqueous solution) (*Jubula*) | 19% |
| Potassium Tripolyphosphate (Rhodia) | 41% |
| Polyacrylic acid (3V Sigma) | 0.85% |
| Dehardened water | 38.2% |
| Blue Dye (Clariant) | 0.0025% |
| Perfume (Givaudan) | 0.3% |
| Sodium sulphate | 6% |
| Sulphonated Polymer (Acusol ™ 588 - Rohm and Haas) | 1.5% |
| Bentzotriazol | 0.2% |

The composition (amounts specified in the following examples) was filled into a container using the following procedure.

A Multivac thermoforming machine operating at 6 cycles/min and at ambient conditions of 25° C. and 35% RH (5% RH) was used to thermoform an anhydrous PVOH film. The PVOH film was prepared by a blown process from granules provided by PVAXX® ref C120 having a degree of hydrolysis of 88% and a thickness of 110 μm. When formed the PVOH has a negligible water content. The PVOH film was wrapped in a sealed polyethylene container which remained sealed until immediately prior to use. The PVOH film was thermoformed into a rectangular mould of 39 mm length, 29 mm width and 16 mm depth, with the bottom edges being rounded to a radius of 10 mm, at 125-148° C. The thus formed pocket was filled with 18.66 g of the composition, afterwards a gelatin pill (10.8 mm diameter) containing phthalimidoperhexanoic acid (PAP) (0.6 g) was dropped in the open capsule and an identical film was placed on top and heat sealed at 154-162° C. The thus produced containers were separated from each other by cutting the flanges. Each container was rounded and had a full appearance. After a few hours they attained an even more attractive, rounded appearance.

Example 3

18.66 g of the heavy duty dishwasher liquid of example 2 was added to the pouch and a PAP containing gelatin capsule (0.6 g PAP particle size 6.4 μm) was also added.

The bleach capability (and other cleaning capabilities) was tested in a General Electrics GSD5130D03WW dishwashing machine using a 55° C. cycle, according to the method IKW. In each case a container comprising the formulation was added at the start of the dishwasher main wash cycle. The water hardness was 9° gH. The results (given in Table 1) are expressed on a scale of 0-10 (0 being worst and 10 being best).

TABLE 1

| Stain | Example. 3 | Comparative Example 3a* |
|---|---|---|
| Bleachable (Tea) | 9.6 | 9.0 |
| Starch - Oat Flakes | 8.8 | 8.8 |
| Starch - Starch Mix | 9.3 | 9.8 |
| Protein - Minced meat | 10.0 | 9.9 |
| Protein - Egg Yolk | 4.9 | 5.2 |
| Protein - Egg Yolk/Milk | 6.0 | 7.1 |
| Burnt-on (milk) | 6.8 | 7.1 |
| | Av. 8.1 | Av. 7.9 |

*PAP particle size >40 μm.

The results show that when the PAP is present in the capsule at a particle size X(50) 6.4 μm the best bleaching cleaning results are obtained. These results are obtained without any detrimental affect upon any of the other cleaning properties.

Example 4

18.66 g of the heavy duty dishwasher liquid of example 2 was added to the pouch and a PAP containing gelatin capsule (0.6 g PAP particle size 6.4 μm) was also added.

The bleach capability (and other cleaning capabilities) was tested in a Bosch SMS 5062 dishwashing machine using a 50° C. cycle, according to the method IKW. In each case a container comprising the formulation was added at the start of the dishwasher main wash cycle. The water hardness was 21 gH. The results (given in Table 2) are expressed on a scale of 0-10 (0 being worst and 10 being best).

TABLE 2

| Stain | Example. 4 | Comparative Example 4 * |
|---|---|---|
| Bleachable (Tea) | 5.0 | 4.1 |
| Starch - Oat Flakes | 8.7 | 8.78 |
| Protein - Minced meat | 3.1 | 2.5 |
| Burnt-on (milk) | 6.6 | 6.6 |
| | Av. 5.9 | Av. 5.1 |

*PAP particle size >40 μm.

The results show that when the PAP is present in the capsule at a particle size X(50) 6.4 μm the best bleaching cleaning results are obtained. These results are obtained without any detrimental affect upon any of the other cleaning properties.

Example 5

The container used in this example has 3 compartments separated from each other In one compartment the PAP composition is filled. 8.4 g of powder are filled into a powder compartment. The gel mixture is heated to 65° C. and stirred for 20 min. Then 6.4 g of gel are filled into a gel compartment and is allowed to chill. Finally the container is sealed with PVOH film.

| Raw Material | Powder (8.4 g) | Gel (6.4 g) | PAP (1.3 g) | Receptacle (2.5 g) | Lid (0.1 g) |
|---|---|---|---|---|---|
| Sodium tripoly-phosphate | 42.5 | | | | |
| Sodium carbonate | 16 | | | | |
| Tri-sodium citrate | 22 | | | | |
| Phosphate speckles | 4 | | | | |
| Benzotriazol | 0.4 | | | | |
| HEDP 4 Na (88.5%) | 0.3 | | | | |
| Protease [1] | 1.5 | | | | |
| Amylase [1] | 1 | | | | |
| TAED | 6 | | | | |
| 1,2-Propylenediglycol | 1 | | | | |
| Dye | 0.02 | | | | |
| Perfume | 0.1 | | | | |
| Sulphonated Polymer [2] | 5 | | | | |
| Sulphonated Polymer [2] | | 5 | | | |
| Surfactant [3] | | 24 | | | |
| Polyglykol [4] | | 9 | | | |
| 1,2-Propylendiglycol | | 1 | | | |
| Dye | | 0.03 | | | |
| Antifoam [5] | | 0.25 | | | |
| TAED | | 3 | | | |
| Sodium tripolyphoshate | | 57.5 | | | |
| Polyglycol 6000 | | 0.3 | | | |
| PAP [6] | | | 100 | | |
| PVOH (container) [7] | | | | 100 | |
| PVOH (lid) [8] | | | | | 100 |
| | 100 | 100 | 100 | 100 | 100 |

[1] Granules which contain approx. 10% active enzyme
[2] AMPS co-polymer
[3] Non-ionic low foaming surfactant
[4] Mixed poly alkoxylate grade, P 41/12000, Clariant
[5] Silicon oil
[6] PAP particle size as indicated in table 4
[7] Composition comprising 85% of low molecular weight PVOH with a degree of hydrolysis being 85-88%, 11% sorbitol and 4% processing aids
[8] PVOH foil, 90 μm, PT grade from Aicello The bleach capability (and other cleaning capabilities) was tested in a Bosch SMS 5062 dishwashing machine using a 50° C. cycle, according to the method IKW. In each case a container comprising the formulation was added at the start of the dishwasher main wash cycle. The water hardness was 21° gH. The results (given in Table 3) are expressed on a scale of 0-10 (0 being worst and 10 being best).

TABLE 3

| Stain | Example. 5** | Comparative Example 5a* |
|---|---|---|
| Bleachable (Tea) | 9.9 | 5.2 |
| Starch - Oat Flakes | 9.0 | 9.2 |
| Protein - Minced meat | 6.0 | 5.8 |

TABLE 3-continued

| Stain | Example. 5** | Comparative Example 5a* |
|---|---|---|
| Burnt-on (milk) | 6.2<br>Av. 7.8 | 6.1<br>Av. 6.6 |

**PAP particle size X(50) <10 μm.
*PAP particle size >100 μm.

The results show that when the PAP is present in the compartment at a particle size of X(50)<10 μm the best bleaching cleaning results are obtained at high water hardness. Additionally these results are obtained without any detrimental affect upon any of the other cleaning properties.

The invention claimed is:

1. A composition comprising phthalimidoperhexanoic acid (PAP), wherein the PAP has a particle size of 0.01 to 100 μm and a particle size distribution wherein 50% by volume of the particles have a particle size of less than 10 μm.

2. A composition according to claim 1, wherein the composition is solid.

3. A composition according to claim 1 wherein the composition is manufactured in a milling process.

4. A composition according to claim 3, wherein the composition is manufactured in a Jet Mill.

5. A composition according to claim 1 wherein the PAP particles are admixed with a peracid stabilisation agent.

6. A composition according to claim 4, wherein the PAP is processed in the presence of a peracid stabilisation agent.

7. A composition according to claim 5 wherein the stabilisation agent is a carbohydrate, a polyol, an oligocarboxylate, a polyacrylate, a polyvinylacetate, a polyvinylalcohol, a polycarbohydrate, a phosphate derivative or a derivative thereof.

8. A composition according to claim 7, wherein the stabilisation agent is a sulphonated polyacrylate polymer, a polycarbohydrate or a derivative thereof.

9. A composition according to claim 7 wherein the stabilising agent is incorporated in an amount of up to 80% wt of the weight of PAP containing particles.

10. A composition according to claim 9 wherein the stabilising agent is incorporated in an amount of up to 60% wt of the weight of PAP containing particles.

11. A composition according to claim 1 wherein PAP particles are granulated either alone or with one or more other ingredients of the composition.

12. A composition according to claim 1 wherein the composition is contained in a water soluble and/or water dispersible pouch.

13. A composition according to claim 12, wherein the pouch is formed of a film, shell, an extruded cage or an injected moulded cage.

14. A composition according to claim 13, wherein the thickness of the film is up to 2 mm.

15. A composition according to claim 14, wherein the thickness of the film is up to 1 mm.

16. A composition according to claim 1 which is a detergent composition.

17. A method for the treatment an article selected from clothes, hard surfaces, and kitchen wares, which method includes the steps of: contacting the said article with composition according to claim 1.

* * * * *

UNITED STATES PATENT AND TRADEMARK OFFICE

CERTIFICATE OF CORRECTION

PATENT NO. : 7,973,002 B2
APPLICATION NO. : 11/913010
DATED : July 5, 2011
INVENTOR(S) : Daniele Fregonese et al.

It is certified that error appears in the above-identified patent and that said Letters Patent is hereby corrected as shown below:

Title page
Under the heading "(30) Foreign Application Priority Data": please remove
~~Jun. 24, 2005 (GB) 0512870.7~~

Signed and Sealed this
Fourth Day of October, 2011

David J. Kappos
*Director of the United States Patent and Trademark Office*